US005161597A

United States Patent [19]

Dohogne

[11] Patent Number: 5,161,597

[45] Date of Patent: Nov. 10, 1992

[54] METHOD FOR THE MASS PRODUCTION OF ROTORS FOR ELECTRIC MOTORS

[75] Inventor: L. Ranney Dohogne, Creve Coeur, Mo.

[73] Assignee: Emerson Electric Co., St. Louis, Mo.

[21] Appl. No.: 745,213

[22] Filed: Aug. 14, 1991

[51] Int. Cl.[5] ..... B22D 19/00

[52] U.S. Cl. ..... 164/109; 164/108

[58] Field of Search ..... 164/108, 109

[56] References Cited

U.S. PATENT DOCUMENTS 2,991,378 7/1961 Barney ..... 164/109

4,214,921 7/1980 Henderson ..... 148/6.35

OTHER PUBLICATIONS

Metals Handbook, ninth Ed. vol. 15 pp. 286-295.

*Primary Examiner*—Kuang Y. Lin

*Attorney, Agent, or Firm*—Polster, Lieder, Woodruff & Lucchesi

[57] ABSTRACT

A method for the mass production of squirrel-cage rotors for electric motors includes the step of die casting-in-place rotor bars within the slots formed by stacked steel laminations. The molten metal alloy utilized in the method consists essentially of aluminum having an iron content of at least 0.4%. The incorporation of this amount of iron in the otherwise pure aluminum substantially reduces the number of defective rotors produced without degrading motor performance to any significant degree.

11 Claims, 1 Drawing Sheet

METHOD FOR THE MASS PRODUCTION OF ROTORS FOR ELECTRIC MOTORS

BACKGROUND OF THE INVENTION

This invention relates to a method for the mass production of squirrel-cage rotors for electric motors.

It is well known to produce squirrel-cage rotors by stamping a plurality of generally circular, high magnetic permeable laminations from thin steel sheet stock. The laminations each include a central bore and a plurality of identical generally radial notches circumferentially spaced at equal angular intervals about the outer margin of the lamination. The laminations are then stacked and compressed within a die casting mold to form a core having a longitudinal central bore therethrough and circumferentially spaced slots which extend longitudinally through the core at the outer margin thereof. The laminations are skewed such that the slots are wrapped slightly around the longitudinal axis of the core in a somewhat helical fashion. Molten metal is then injected into the slots formed by the laminations to produce spaced bars along the outer margins of the core as well as end rings which hold the laminations in place.

It is also known that in order to produce the very best motor performance possible, the conductivity of the bars should be as high as possible. It has been generally accepted that the bars should be formed from the highest purity aluminum and thus the highest conductivity aluminum, which is available. The aluminum which has been generally utilized by motor manufacturers has a very low iron content of about 0.1% to 0.2%. For purposes of maintaining the highest conductivity possible of the aluminum, it has been the desire of rotor manufacturers to obtain aluminum of even greater purity and having an even less iron content. The conventional thinking in the industry has been that any further contamination of the rotor aluminum with iron would degrade the performance of the rotor, thus producing an inferior motor.

A problem that has plagued mass producers of electric motors for many years is that when aluminum is injected into the rotor core to form the rotor, the aluminum inconsistently forms voids during the casting process. These voids are not detectable by visual inspection. The voids, however, exhibit themselves in electrical tests when the motors demonstrate overall poor performance and excessively noisy operation. The only practical ways for determining when voids are formed is to test each motor prior to shipment, or to have motors fail in applicational use.

It is known in the art that molten aluminum is very aggressive toward unprotected steels. That is to say, molten aluminum often solders to unprotected steels.

It was also common in past motor manufacturing procedures to heat treat laminations after punching to mitigate aluminum soldering in rotor casting. That is, stator and rotor laminations often still are heat treated to form an oxide layer on the bare metal. When oxidation steps are provided in a motor construction, they adds cost to the product and the degree of oxidation is hard to control. Consequently, even where oxidation steps are included in the motor manufacturing process, it still is possible to have production problems with rotors using conventional construction techniques.

I have found that contrary to the conventional thinking in motor manufacturing, rotor grade aluminum, that is, high purity aluminum exhibiting superior electrical performance per se, not only need not be used in rotor manufacture, but that overall motor performance can be improved when rotors are constructed according to the method of my invention.

SUMMARY OF THE INVENTION

It is an object of the invention to provide a method for the mass production of squirrel-cage rotors for electric motors which eliminates the need for burn-off or chemical oxide treatments of the lamination core prior to injection of molten aluminum into the lamination core, and which alleviates the problems associated with soldering of the aluminum to the core.

It is a further object of the invention to provide a method for the mass production of squirrel-cage rotors which utilizes a molten aluminum alloy for casting-in-place rotor bars within the lamination core consisting essentially of aluminum purposefully having an iron content of at least 0.4% and substantially free of impurities in order to reduce the number of motors which are faulty and which must be scrapped, without significantly reducing conductivity losses and motor performance of the motors produced according to the method of the present invention.

It is a still further object of the invention to provide a more economical method of mass producing squirrel-cage rotors for electric motors using less expensive materials and procedures while decreasing the rate of defective motor production.

It has been discovered that when rotors are produced utilizing an aluminum alloy containing at least 0.4% iron, and preferably between 0.5% and 1.1% iron, the manufacturing problems associated with the conventional, extremely high purity aluminum can be alleviated, and the pull-up torque performance of a motor utilizing a rotor produced according to the invention will not be affected to any significant degree, and the number of defective motors produced during the production run will be significantly decreased or even eliminated.

When utilized for the mass production of rotors for electric motors, the present invention provides the advantages of: 1) reducing the number of defective motors produced; i.e., those which do not exhibit the proper level of pull-up torque; 2) lengthening the usable life of the die-cast rotor mold; 3) permitting the use of a less expensive aluminum alloy in the die-cast process; and 4) allowing the rotor to be more economically produced by eliminating the need for oxidizing the core prior to injection of the aluminum alloys. All of these advantages are effected by instituting the present method which contradicts conventional wisdom regarding the iron content of rotor bar aluminum.

These as well as other objects and advantages will become more apparent upon a reading of the following description of the preferred embodiments wherein the structure of a rotor for an electric motor is illustrated, and the prior art method and the method of the present invention are compared.

DESCRIPTION OF THE PREFERRED EMBODIMENT

Figure 1:
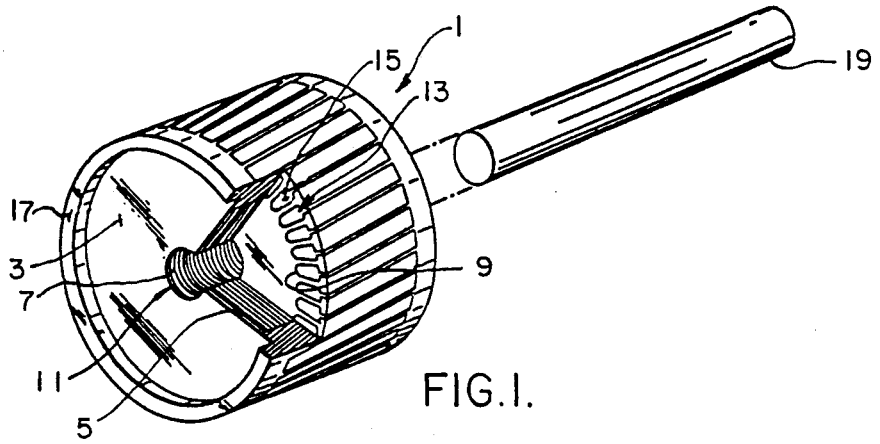
FIG. 1 is a perspective view of a squirrel-cage rotor body with a portion thereof cut away for the purpose of illustrating the individual laminations comprising the core of the rotor bars formed in notches in the outer periphery of the core and with a rotor shaft adapted to be shrink fitted in the bore of the rotor body.
Figure 2:
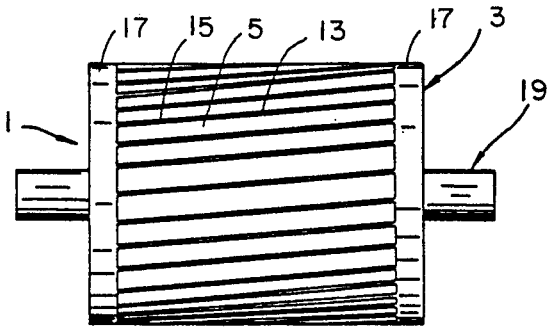
FIG. 2 is a side elevational view of a rotor assembly after having its rotor shaft fitted in its bore.

Referring now to the drawings, a rotor body, as indicated in its entirety by reference character 1, is shown to comprise a core 3 constituted by a stack of identical laminations 5 which are preferably made of thin, plate-like ferro-magnetic material, such as a high magnetic permeability sheet steel or the like. As is conventional, laminations 5 are die punched from sheet steel and have a central opening 7 therethrough and a plurality of identical generally radial notches 9 in their outer margins with the notches spaced at equal angular intervals about the lamination. Upon assembly of the stack of laminations to form the core, the laminations are coaxially arranged so that their central openings 7 form a bore 11 extending longitudinally through the core. The laminations are preferably skewed relative to one another (i.e., angularly displaced from one another) so that their notches 9 form slots 13 which extend longitudinally through the core and which are wrapped slightly around the longitudinal axis of the core in helical fashion. The laminations constituting core 3 are typically secured together in stacked relation under a desired compressive loading by any one of several known means, and the injected aluminum holds the core in desired arrangement after manufacturing. The rotor assembly illustrated is a squirrel-cage rotor and, as is typical, has a plurality of die cast-in-place rotor bars 15 formed within slots 13 and further has die cast end rings 17 formed on the end faces of core 3 unitary with and interconnecting the rotor bars. Typically, core 3 is placed within a die-casting mold (not shown) as an interlocked assembly making it difficult to properly burn-off or oxidize the laminations. Molten aluminum is injected under pressure of a piston, or the like, into the mold, the molten aluminum flows into slots 13 to form bars 15, filling the mold cavity to create end rings 17. After die casting, the core assembly, as illustrated in FIG. 1, may be turned in a lathe or other suitable machine so as to form a uniform and even outer cylindrical surface concentric with the axis of bore 11. However, it is preferable to use laminations punched to size to eliminate the turning step.

Bore 11 in core 3 is sized and formed as to be shrink or otherwise fitted on a rotor shaft 19. That is, the inside diameter of bore 11 is slightly smaller at ambient temperature than the outside diameter of shaft 19 so that upon heating of core 3 to a predetermined elevated temperature, the inside diameter of bore 11 will expand or increase to a size sufficient to receive shaft 19 therewithin. Upon cooling of the core, the latter will contract around the shaft and will securely lock it in place therein thus fixing the core to the shaft. Other interconnecting methods are known in the art and all are compatible with the broader aspects of my invention.

According to the method of the present invention, instead of utilizing the very high purity, and more expensive, aluminum conventionally injected into the rotor lamination core, an aluminum alloy having an iron content of at least 0.4% but less than about 1.1% is injected into the rotor laminations to produce rotor bars 15 and rotor end rings 17. When such aluminum alloy having increased iron content is used, the tendency for aluminum soldering to the lamination core is alleviated. Thus, the problem of a shorting condition between bars and the lamination is alleviated. Also, the aluminum alloy used according to the present method exhibits a reduced tendency to dissolve or solder to the die mold walls, thus increasing usable rotor mold life. These advantages are obtained even though the expensive procedure of oxidizing the lamination core can be eliminated, as explained hereinbefore.

For best results, it has been discovered that the shot speed, that is, the speed of filling slots 13 with molten aluminum alloy should be kept relatively low. A shot speed of about 40.0 inches/second has produced acceptable results. It is noted that the higher the iron content, the higher the shot speed can be; however, as the iron content increases, conductivity is reduced. It is recommended that the iron content be less than about 1.1%.

Test Results

Table A below confirms the improvement in the art provided by the novel method of the present invention. In all cases no oxidation (burn-off or chemical treatment) step was employed during the production of the rotors. All rotors were die cast-in-place using a low shot speed of about 28.5 inches/second. A motor which exhibited a pull-up torque of greater than 6.5 ounce-feet was considered to perform adequately for its designed purpose, while those that exhibited a pull-up torque less than 6.5 ounce-feet were considered defective.

| IRON CONTENT IN ALUMINUM | NUMBER OF MOTORS WHICH PERFORMED ADEQUATELY | NUMBER OF MOTORS WHICH WERE DEFECTIVE |
|---|---|---|
| A. 0.15% | 3 | 3 |
| B. 0.5% | 6 | 0 |
| C. 0.8% | 6 | 0 |

It can readily be seen that according to Row A above when the iron content of the molten aluminum alloy was 0.15% as is conventional, there was a 50% defective rate in the test motors since no oxidation step was performed on the mold and lamination core. When the iron content was raised to both 0.5% and 0.8% and no oxidation step was performed, as shown by Rows B and C, the motor defective rate was reduced to zero.

It should be understood that if an excessive amount of iron content (i.e. greater than about 1.1%) is present in the aluminum of the rotor bars, the motor performance will degenerate to a point that it will be unacceptable.

Figure 3:
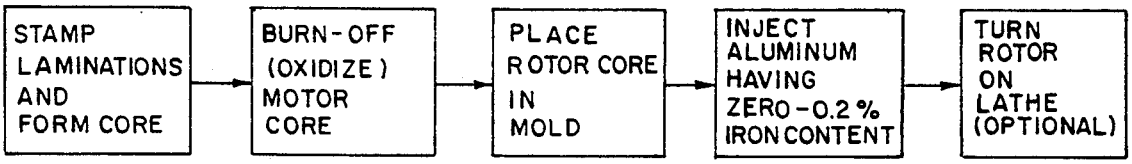
FIG. 3. PRIOR ART.
FIG. 3 is a flow chart of the principal steps in forming a squirrel-cage rotor according to the prior art method.

With reference to FIG. 3, there is shown in simplified form a flow chart of a prior art method of mass producing squirrel-cage rotors as is conventionally performed. The prior art method contains four basic steps including 1) stamping the laminations and forming the rotor core from a plurality of laminations; 2) burning-off or other oxidizing treatment of the rotor lamination; 3) placing the rotor lamination as a core in the mold; and 4) injecting aluminum having zero to 0.2% iron content into the core and mold. If the laminations have not been punched to size, then the optional step of turning the rotor on a lathe may be performed.

Figure 4:
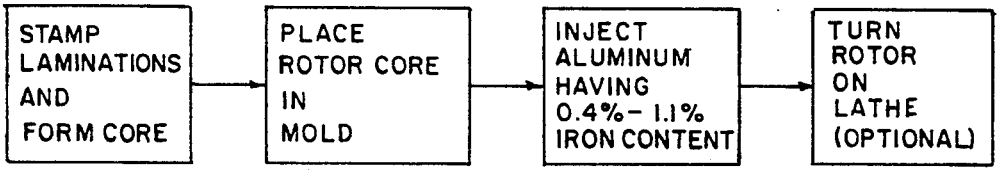
FIG. 4 is a flow chart of the principal steps in mass producing squirrel-cage rotors according to the present invention.

Now referring to FIG. 4, it can be seen that not only does a rotor formed by the method of the present invention exhibit an increased rate of acceptable motors per production run, but also eliminates a production step and permits the utilization of lower cost aluminum alloy. The present invention includes the steps of 1) stamping the laminations and forming the rotor core; 2) placing the rotor laminations as a core in the mold; 3) injecting aluminum alloy having an iron content in the range of about 0.4% to 1.1%. Again, if the laminations are not already punched to size, the optional step of turning the rotor on a lathe may be performed.

It has thus been shown that in contradiction to the generally accepted principles of mass production of rotors where it was thought that the less the iron content the better, it is in fact advantageous to increase the iron content in the die cast-in-place aluminum rotor bars in the range of about 0.4% to about 1.1% in order to decrease the number of defective motors produced during a production run and enable the elimination of the lamination core and mold oxidation step. The novel process produces a greater number of acceptable quality motors while reducing the cost of each motor.

In view of the above, it will be seen that the several objects and features of this invention are achieved and other advantageous results attained.

As various changes could be made in the above method or process without departing from the scope of this invention, it is intended that all matter contained in the above description or shown in the accompanying drawings shall be interpreted as illustrative and not in a limiting sense. The scope of the protection of this invention is to be determined solely by the language of the following claims.

Having thus described the invention, what is claimed and desired to be secured by Letters Patent is:

1. A method for the mass production of squirrel-cage rotors for electric motors comprising the steps of:

stamping a plurality of high magnetic permeability laminations, each lamination having a central bore and a plurality of identical generally radial notches circumferentially spaced at equal angular intervals about the outer margin thereof;

placing a plurality of said laminations within a mold to form a core having a longitudinal central bore therethrough and to form circumferentially spaced slots which extend longitudinally through said core at the outer margin thereof and which are wrapped slightly around the longitudinal axis of said core in helical fashion;

die casting-in-place rotor bars within said slots using a molten metal alloy consisting essentially of aluminum having an iron content of at least 0.4%.

2. The method as specified in claim 1 wherein:

said molten metal alloy consists essentially of aluminum having an iron content in the range between about 0.4% and about 1.1%.

3. The method as specified in claim 2 wherein;

said molten metal alloy consists essentially of aluminum having an iron content in the range between about 0.5% and about 0.8%.

4. The method as specified in claim 1 wherein:

the speed at which the aluminum alloy is injected into said slots is maintained at a low level.

5. The method as specified in claim 4 wherein:

the speed at which the aluminum alloy is injected into said slots is less than or equal to about 40.0 inches/-second.

6. The method as specified in claim 1, and including the additional step of:

removing the rotor from the mold and turning the rotor to form a uniform and even outer cylindrical surface concentric with the central bore.

7. A method of constructing a rotor for a dynamo-electric machine comprising the steps of:

placing a plurality of laminations in a mold, each of said laminations having a plurality of rotor bar openings formed along their periphery at predetermined angular intervals thereabout, each of said rotor bar openings being aligned in a predetermined manner in said lamination plurality;

diecasting in place rotor bars within said rotor bar openings using a molten metal alloy consisting essentially of aluminum having an iron content of at least 0.4%.

8. The method of claim 7 wherein the metal alloy consists essentially of aluminum having an iron content in the range between about 0.4% and about 1.1%.

9. The method of claim 8 including the additional step of:

removing the rotor from the mold and turning the rotor to form a uniform and even outer cylindrical surface for the rotor.

10. A method of constructing a rotor comprising the steps of:

stamping a plurality of rotor laminations, each of said rotor laminations having a central bore and a plurality of peripheral openings formed in it, said peripheral openings of said laminations being alignable so that said peripheral openings form rotor bar slots for said rotor;

placing a plurality of said laminations within a mold to form a core having a predetermined stack height, said core having a longitudinal central bore thus through, said slots defining a plurality of rotor bar slots;

melting a metal alloy consisting essentially of aluminum having an iron content in the range between about 0.5% and about 0.8%;

casting rotor bars within said slots using said molten metal alloy.

11. The method of claim 10 further including the steps of forming end rings at opposite ends of said rotor for shorting said rotor bars;

* * * * *